United States Patent [19]

Sato et al.

[11] 3,991,709

[45] Nov. 16, 1976

[54] REGENERATING DEVICE FOR DEVELOPING LIQUID

[75] Inventors: Tadashi Sato, Kokubunji; Ikuo Soma, Tokyo, both of Japan

[73] Assignee: Canon Kabushiki Kaisha, Tokyo, Japan

[22] Filed: Apr. 28, 1975

[21] Appl. No.: 572,333

Related U.S. Application Data

[63] Continuation of Ser. No. 449,079, March 7, 1974, abandoned, which is a continuation of Ser. No. 222,110, Jan. 31, 1972, abandoned.

[30] Foreign Application Priority Data

Feb. 9, 1971 Japan ..... 46-5495
June 10, 1971 Japan ..... 46-41343

[52] U.S. Cl. ..... 118/612; 118/637; 355/15; 118/603

[51] Int. Cl.[2] ..... B05C 11/00

[58] Field of Search ..... 118/603, 610, 612, 637; 355/3 P, 10, 15

[56] References Cited

UNITED STATES PATENTS

| | | | |
|---|---|---|---|
| 3,292,577 | 12/1966 | Cressey, Jr. et al. | 118/603 |
| 3,334,613 | 8/1967 | Young | 118/637 |
| 3,354,867 | 11/1967 | Pomper et al. | 118/603 |
| 3,421,477 | 1/1969 | Gilbert et al. | 118/612 |
| 3,561,400 | 2/1971 | Smitzer et al. | 118/637 |
| 3,598,487 | 8/1971 | Mizyguchi et al. | 355/15 |
| 3,709,594 | 1/1973 | Hastwell | 118/612 |
| 3,927,409 | 12/1975 | Kase et al. | 118/637 |

*Primary Examiner*—Mervin Stein
*Assistant Examiner*—Douglas Salser
*Attorney, Agent, or Firm*—Fitzpatrick, Cella, Harper & Scinto

[57] ABSTRACT

A device for regenerating developing liquid used in an electrophotographic copying machine of the liquid development type comprises a container for developing liquid. The container includes therein inlet means for admitting used liquid into the container, means for subdividing condensed toner contained in the used liquid, means for filtering the admitting used liquid to pass the subdivided toner therethrough, and outlet means for directing the filtered liquid out of the container.

7 Claims, 10 Drawing Figures

REGENERATING DEVICE FOR DEVELOPING LIQUID

This is a continuation of application Ser. No. 449,079, filed Mar. 7, 1974, now abandoned, which, in turn, is a continuation of application Ser. No. 222,110, filed Jan. 31, 1972, and now abandoned.

BACKGROUND OF THE INVENTION

1. Field of the Invention:

This invention relates to a regenerating device for developing liquid, and more particularly to such a device used in an electrophotographic copying apparatus to re-disperse condensed toner present either in used developing and/or cleaning liquid collected from a developing and/or cleaning device or in developing liquid contained in the developing device and to prepare such liquid for reuse.

2. Description of the Prior Art:

With the electrophotographic copying machines employing a liquid for development, it is usually often the case that condensed toner is formed in the developing liquid, and such condensation of toner is particularly liable to occur when the developing liquid contains a fixing agent or the like. Such condensed toner would form into masses which would cause stains or blots to be created in a resulting developed image or which would, in the case of transfer type electrophotographic copying machines, injure the surface of a photosensitive medium due to a pressure imparted thereto when the developed image is transferred to a transfer medium or when the surface of the photosensitive medium is cleaned. In addition, the condensed toner tends to clog developing liquid supply pipes or similar means or to contaminate the interior mechanism of the developing device. For these reasons, the developing liquid with such condensed toner formed therein is not suitable for reuse and the liquid used for the purpose of development to a certain degree must be disused, which means a great econmical disadvantage. Moreover, the interior of the developing device or the liquid supply pipes must be frequently cleaned through cumbersome procedures every time they are contaminated or clogged by the condensed toner. In this regard, it is desirable to carry out some suitable treatments such as removal or re-dispersion of the condensed toner induced in the developing liquid.

SUMMARY OF THE INVENTION

It is therefore a principal object of the present invention to provide an improved regenerating device for developing liquid which enables used developing liquid in an electrophotographic copying apparatus to be regenerated for repeated use.

It is another object of the present invention to provide an improved regenerating device for developing liquid which enables condensed toner present in the used developing liquid to be subdivided and re-dispersed for reuse.

It is still another object of the present invention to provide an improved regenerating device for developing liquid which is provided with filter means for filtering the developing liquid with condensed toner and passing re-dispersed developing toner therethrough.

It is yet another object of the present invention to provide an improved regenerating device for developing liquid in which the developing liquid may be stirred to re-disperse the condensed toner present therein.

It is yet still another object of the present invention to provide an improved regenerating device for developing liquid in which a stream of developing liquid produced by stirring the liquid may be positively imparted as a pressure to the surface of the filter to thereby enhance the filter effect.

With the regenerating device for developing liquid according to the present invention, any condensed toner present in developing and/or cleaning liquid once used in a developing and/or cleaning device may be filtered through a filter which passes solely the developing toner suitable for the purpose of development so that the used developing liquid may be regenerated for reuse as developing liquid free of condensed toner. Further, the used developing liquid may be turbulently stirred by a stirrer or like means so that the condensed toner therein may be re-dispered throughout the liquid to provide reusable developing toner, which may in turn be filtered through the filter for regeneration and reuse as effective developing liquid. The developing liquid after stirred to re-disperse the condensed toner therein is applied to the filter in the form of a stream under high pressure, thereby achieving an enhanced dispersion and filtering effect which in turn leads to the provision of a high-speed regenerating device for developing liquid.

BRIEF DESCRIPTION OF THE DRAWINGS

Some specific embodiments of the present invention will be described hereunder in conjunction with the accompanying drawings, in which.

DESCRIPTION OF THE PREFERRED EMBODIMENTS

Figure 1:
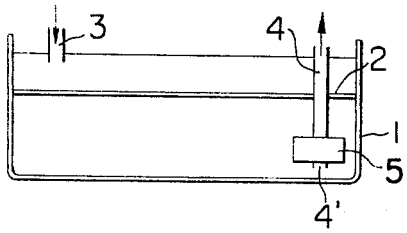
FIG. 1 is a cross-sectional view of the regenerating device for developing liquid according to a basic embodiment of the present invention.

Referring to FIG. 1 of the drawings, throughout which similar parts are designated by similar numerals, there is shown the basic embodiment of the regenerating device for developing liquid according to the present invention. Within a developing liquid tank 1, there extends a filter 2 horizontally below a predetermined level of developing liquid. The filter 2 is adapted therethrough solely toner particles having grain diameters smaller than a predetermined value. Developing liquid once used in a developing or cleaning device (not shown) and containing some condensed toner may flow into the tank 1 through an inlet 3 and may be filtered through the filter 2. The filtered developing liquid containing therein developing toner suitable for the purpose of developing may be transported by a pump 5 through an outlet 4 to the developing device. Thus, the portion of the developing liquid in the tank 1 under the filter 2 is free of condensed toner and such portion of the developing liquid, which is free of condensed toner and suitable for the purpose of development, may be sucked upwardly through a suction port 4'. As the result, the developing device may always be supplied with developing liquid suitable for development.

In this way, the filter 2 separating the liquid tank 1 into upper and lower compartments enables the developing liquid containing condensed toner to be filtered due to gravity without utilizing any extraneous power. Thus, the device shown in FIG. 1 is very simple and economical to construct as well as free of operational trouble.

Figure 2:
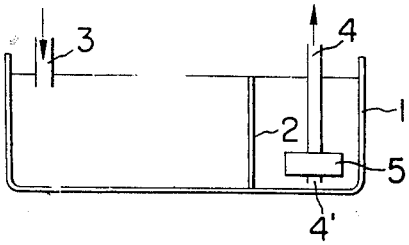
FIG. 2 is a similar view of a modification of the regenerating device shown in FIG. 1.

FIG. 2 shows a modified form of the present invention in which filter 2 is disposed vertically in the tank 1 so as to separate the tank into right and left compartments having an inlet 3 and an outlet 4, respectively. This embodiment achieves the same effect as that attained by the embodiment of FIG. 1.

Figure 3:
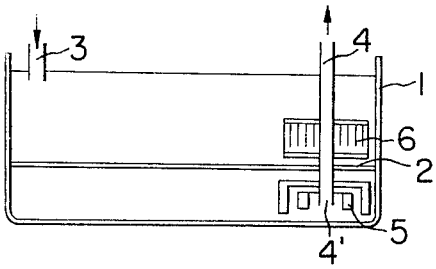
FIG. 3 is a cross-sectional view showing a form of developing liquid stirrer means in the regenerating device of FIG. 1.

FIG. 3 shows a further embodiment of the present invention which includes a developing liquid stirring fan 6 provided in the tank 1 to stir the liquid with condensed toner particles impassable through the filter 2 of FIG. 1 or 2 so as to form a turbulent stream of developing liquid, whereby the condensed toner particles in the turbulent stream may be subdivided due to their friction with the developing liquid or to their contact with the filter. With this arrangement, the loss of toner arising from its condensation may be reduced significantly. A liquid pump 5 is also provided in the tank adjacent to the suction port 4'. In this embodiment, the filter 2 may be more advantageous in achieving the subdividing effect if it is disposed far below the level of the developing liquid in the tank 1.

Figure 4B:
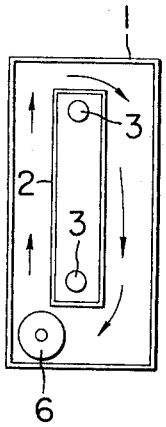
FIGS. 4(*a*) and (*b*) are a perspective view and a front view, respectively, of the regenerating device in which the filter shown in FIGS. 1–3 takes the form of a box through which developing liquid is passed to be stirred.
Figure 4A:
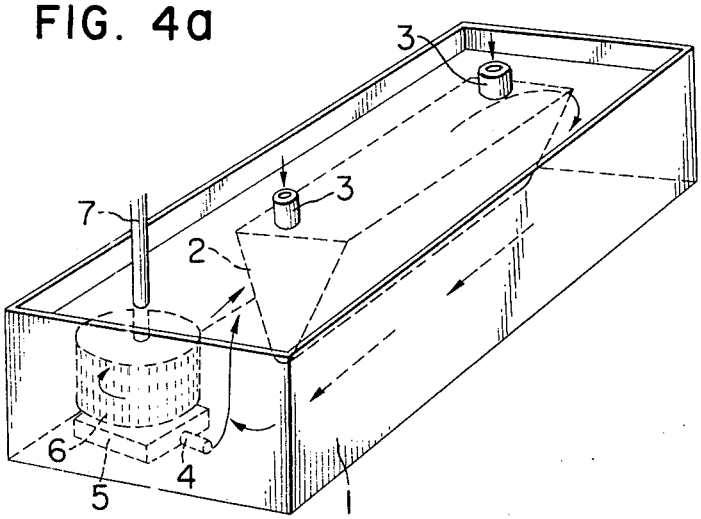

FIGS. 4*a* and 4*b* illustrate, respectively, perspective and top views of a form of the regenerating device for developing liquid in which filter 2 is in the form of a container having a V-shaped cross section and inlet ports 3 are formed in the upper surface of the filter to admit liquid from means such as developing and cleaning devices (not shown).

Within the tank 1 but outside the filter 2 there are disposed a developing liquid stirrer 6 and a pump 5 for supplying the developing liquid through outlet 4 to the developing device so that they are immersed in the body of developing liquid in the tank. The stirrer 6 and pump 5 are both driven to rotate by a common motor shaft 7.

As it is stirred by the stirrer 6, the developing liquid is circulated through the tank and past the filter 2 as indicated by arrows. On the other hand, the V-shaped filter 2 receives used liquid from developing and cleaning devices through the inlets 3 and filters such used liquid. Thus, any condensed toner present in the used liquid may be collected within the V-shaped filter 2 and subdivided by the circulated flow of liquid shown by arrows, thereby passing through the filter.

Figure 5:
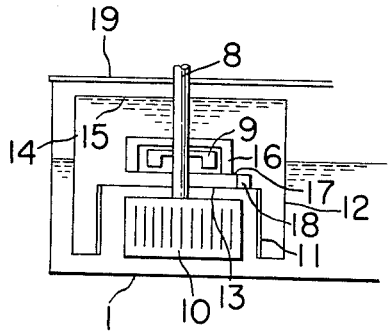
FIGS. 5 to 8 are cross-sectional views showing other forms of the regenerating device in which a stream of developing liquid produced by stirring the liquid is imparted to the filter.

In FIG. 5, there is shown a further embodiment which includes a pump impeller 9 mounted in the tank 1 on an intermediate portion of a rotatable shaft (motor shaft) 8, and a Silocco stirrer fan 10 mounted at the lower end of the shaft 8.

Rotation of the Silocco stirrer fan 10 causes the developing liquid to be sucked upwardly from the bottom portion of the liquid tank 1 and to flow out in a turbulent stream in the direction of rotation of the stirrer fan 10. Surrounding the rotating fan 10 is an upright annular filter 11, which in turn is surrounded by an upright annular pump wall 12 for maintaining a level of developing liquid. The annular pump wall 12 is integral with the annular filter 11 at the bottom edge thereof. The filter 11 is provided with a horizontal partition wall 13 which is integral with the filter at the top edge thereof. The partition wall 13 and the annular pump wall 12 together define a cylindrical compartment 14 isolated from the developing liquid contained in the tank 1. With the rotation of the stirrer 10, the pressure of the developing liquid against the filter 11 is increased so that the developing liquid is filtered through the filter to raise the liquid in the compartment 14 to a level 15. The condensed toner particles present in the developing liquid are repeatedly thrown against the filter 11 due to the rapid rotation of the stirrer 10 and to the aforesaid increased liquid pressure until they are subdivided and re-dispersed. The developing liquid thus increased in pressure raises the level in the cylindrical compartment 14. Above the partition wall 13 there is a pump comprising pump impeller 9, pump housing 16, pump plate 17 and pump support 18. The portion of the developing liquid which has been filtered through the filter 11 as described is supplied by the pump to the means such as developing and cleaning devices via supply pipes or the like (not shown).

With regard to the stirring, a flow of liquid may be formed to accomplish circulation of stirring by setting the direction in which the developing liquid is attracted to the stirrer blades.

It will thus be appreciated that the pump above the partition wall 13 sucks developing liquid free of condensation and suitable for development so that the developing device is always supplied with such effective developing liquid.

Figure 6:
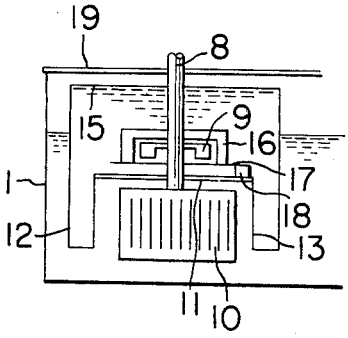

FIG. 6 shows an embodiment in which filter 11 is disposed over and over Silocco stirrer 10 so as to filter the developing liquid during the rotation of the stirrer. This arrangement results in the same effect as that attained in FIG. 5, but the fact that the lower end of the stirrer 10 is projected downwardly beyond the lower end of upright annular partition wall 13 is useful to form a rapid flow of liquid which ensures a good stirring effect as the stirrer 10 is rotated.

Figure 7:
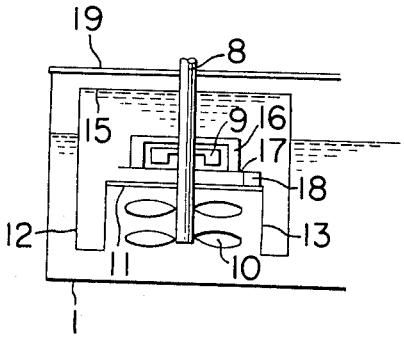

FIG. 7 shows a further embodiment which employs a propeller type stirrer 10 and a filter 11 disposed over and above the stirrer. This arrangement again achieves the same effect as that of FIG. 5.

Figure 8:
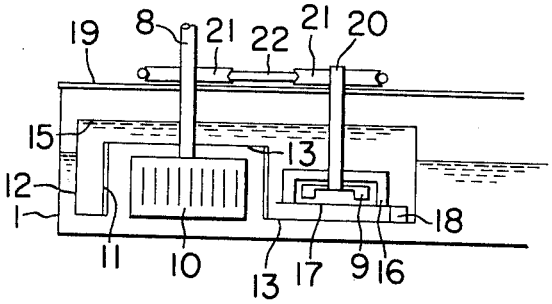

In FIG. 8, stirrer 10 and pump 9 are discretely mounted on rotatable shaft 8 and pump shaft 20, respectively, and these shafts are provided with pulleys 21 and rotated by a belt 22. In this case, there is an advantage that the liquid pressure caused by the stirrer 10 need not be so high as described above.

Figure 9:
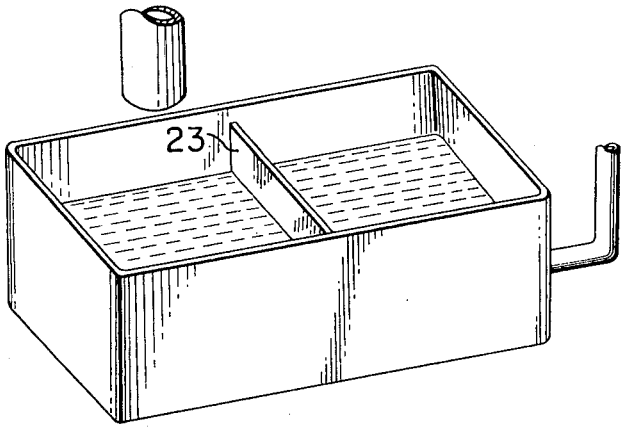
FIGS. 9 and 10 are perspective views showing improved forms of the regenerating device in which condensed toner present in the developing liquid may be re-dispersed more effectively.
Figure 10:
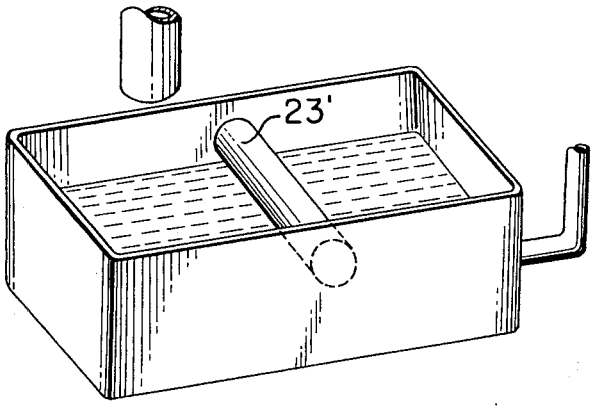

FIG. 9 shows a further embodiment of the regenerating device for developing liquid in which re-dispersion of condensed toner may be accomplished by forced application of liquid flow, together with the effect provided by a slide plate 23 frictionally slidable with respect to filter 2. Thus, any condensed toner particles which could not be re-dispersed by the liquid flow alone may be mechanically re-dispersed with a high efficiency. The embodiment of FIG. 9 using such a slide plate achieves a more efficient re-dispersion effect than a further embodiment wherein the plate is replaced by a roller 23, as shown in FIG. 10.

In the various embodiments described above with respect to FIGS. 1 to 10, the material suitable to form the filter should be an electrically conductive one rather than non-conductive material which tends to generate electric charges due to friction and attract toner of the liquid to rapidly reduce the filter effect. In addition, the material of the filter should preferably be resistant to the corrosion from developing or cleaning liquid. The present invention has employed stainless brass screen of 100 to 250 meshes for the filter material. Such screen has passed therethrough only the toner particles of 5 to 10 microns in grain diameter and rejected any larger toner particles. When the embodiments of FIGS. 3–8 and FIG. 10 have been carried out by using such a filter with the flow rate of the developing liquid selected in the range of 200 to 500 mm./sec. with respect to the filter, satisfactory re-dispersion of condensed toner has been attained. Further, the slide plate member of FIG. 9 slidable with respect to the filter surface may be formed of rubber, synthetic resin, metal or other suitable material, but again this slide member must be electrically conductive and anti-corrosive.

As has been described hitherto, the regenerating device for developing liquid according to the present invention can effectively regenerate the liquid with condensed toner once used in the developing and/or cleaning device so that such liquid can be repeatedly used to a great economical advantage. Moreover, development is effected without any condensed toner contained in the developing liquid, thus resulting in a highly excellent developing effect. Furthermore, the developing and cleaning devices may be protected from contamination and the liquid supply piping may be free of clogging due to condensed toner, thereby facilitating the maintenance of these parts with reduced necessity for repair.

We claim:

1. An electrophotographic apparatus wherein a developing liquid containing toner particles is applied to an electrophotographic photosensitive member, in a development process, said apparatus comprising:

a container for recovering the developing liquid which has been used in the development process;

means for stirring the developing liquid within said container;

filter means disposed at such a position that liquid flow caused by said stirring means impinges thereon, wherein said filter means passes the toner particles contained in the liquid, and wherein said filter means subdivides condensed masses of toner particles impinged thereagainst by said liquid flow; and means for feeding the developing liquid which has passed through said filter means for said developing liquid application during the development process, whereby the developing liquid is used repeatedly.

2. An apparatus according to claim 1, wherein said filter means is of a conductive material.

3. An apparatus according to claim 1, wherein said filter means is non-corrosive to the liquid developer.

4. An apparatus according to claim 1, wherein said feeding means includes a pump.

5. An apparatus according to claim 1, wherein said feeding means also serves as said stirring means.

6. An apparatus according to claim 1, wherein said filter means encloses said feeding means.

7. An electrophotographic apparatus wherein a developing liquid containing toner particles is applied to an electrophotographic photosensitive member to develop an image thereon, the developed image is then transferred onto a transfer material, and the surface of the photosensitive member is then cleaned with a cleaning liquid, said apparatus comprising:

a container for recovering at least one of the developing liquid applied to said member and the cleaning liquid used for cleaning said member;

means for stirring the liquid within said container;

filter means disposed at such a position that liquid flow caused by said stirring means impinges thereon, wherein said filter means passes the toner particles contained in the recovered liquid, and wherein said filter means subdivides condensed masses of toner particles impinged thereagainst by said liquid flow; and means for feeding the liquid which has passed through said filter means for application to said developing member during said image development, whereby the recovered liquid is used repeatedly.

* * * * *